US006825452B2

(12) United States Patent
Oh

(10) Patent No.: US 6,825,452 B2
(45) **Date of Patent: *Nov. 30, 2004**

(54) MICROWAVE OVEN TO COOK FOOD WITH STEAM GENERATED THROUGH A MICROWAVE HEATING OPERATION

(75) Inventor: Keun-Seuk Oh, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 66 days.

This patent is subject to a terminal disclaimer.

(21) Appl. No.: 10/336,764

(22) Filed: Jan. 6, 2003

(65) Prior Publication Data

US 2004/0035860 A1 Feb. 26, 2004

(30) Foreign Application Priority Data

Aug. 22, 2002 (KR) ..... 2002-49903

(51) Int. Cl.[7] ..... H05B 6/80

(52) U.S. Cl. ..... 219/682; 219/731; 219/756; 219/734; 99/DIG. 14; 99/330

(58) Field of Search ..... 219/682, 680, 219/732, 731, 734, 735, 756, 762, 763; 99/DIG. 14, 330, 331, 443 R; 426/113, 234, 243; 126/338, 339

(56) References Cited

U.S. PATENT DOCUMENTS

| | | | | | |
|---|---|---|---|---|---|
| 2,919,336 | A | * | 12/1959 | Hahn | 219/746 |
| 2,956,144 | A | * | 10/1960 | Woodman | 219/756 |
| 5,252,797 | A | * | 10/1993 | Komatsu | 219/729 |
| 6,730,895 | B2 | * | 5/2004 | Kim | 219/682 |

FOREIGN PATENT DOCUMENTS

| | | | | |
|---|---|---|---|---|
| JP | 53-72245 | * | 6/1978 | 219/685 |
| KR | 1995-16626 | | 7/1995 | |
| KR | 1019980152145 | | 6/1998 | |
| KR | 1020010010611 | | 2/2001 | |

* cited by examiner

*Primary Examiner*—Philip H. Leung
(74) *Attorney, Agent, or Firm*—Staas & Halsey LLP

(57) ABSTRACT

A microwave oven, capable of cooking food by steam generated through a microwave heating operation. The microwave oven includes a cabinet provided with a cooking cavity and a microwave irradiating unit irradiating microwaves into the cooking cavity. The microwave oven includes a steaming unit. The steaming unit includes a steaming container and a cover. The steaming container is made of a microwave penetrable material and is installed to an upper portion of the cabinet such that a lower portion of the steaming container is placed in the cooking cavity. The steaming container is open at a top thereof and the cover selectively closes the open top of the steaming container.

28 Claims, 3 Drawing Sheets

MICROWAVE OVEN TO COOK FOOD WITH STEAM GENERATED THROUGH A MICROWAVE HEATING OPERATION

CROSS-REFERENCE TO RELATED APPLICATION

This application claims the benefit of Korean Application No. 2002-49903, filed Aug. 22, 2002, in the Korean Intellectual Property Office, the disclosure of which is incorporated herein by reference.

BACKGROUND OF THE INVENTION

1. Field of the Invention

The present invention relates, in general, to microwave ovens and, more particularly, to a microwave oven capable of cooking food using steam.

2. Description of the Related Art

As is well known to those skilled in the art, a conventional microwave oven is an appliance, which cooks food placed in a cooking cavity thereof using microwaves from a magnetron to irradiate the cooking cavity. Typically, an electric heater cooks the food by heating surfaces of the food, but the microwave oven cooks the food by heating an interior of the food through a dielectric heating operation. When the microwaves from the magnetron of the microwave oven irradiate the food and cause molecules of moisture laden in the food to vibrate, frictional heat is generated within the food and cooks the food.

However, the conventional microwave oven is problematic in that a taste and an appearance of the food are deteriorated when the moisture laden in the food is removed from the food. The moisture laden in the food is removed from the food by the frictional heat generated when the microwaves from the magnetron irradiate the food causing the molecules of the moisture laden in the food to vibrate. The conventional microwave oven has another problem in that cooking steamed food to which water must be added during cooking is difficult.

SUMMARY OF THE INVENTION

Accordingly, it is an aspect of the present invention to provide a microwave oven, which is capable of cooking food by steam generated through a microwave heating operation.

Another aspect is to provide a microwave oven, which is capable of cooking through a microwave heating operation and through a steam heating operation at the same time.

Additional aspects and/or advantages of the invention will be set forth in part in the description which follows and, in part, will be obvious from the description, or may be learned by practice of the invention.

The foregoing and/or other aspects are achieved by providing a microwave oven, comprising a cabinet provided with a cooking cavity and a microwave irradiating unit irradiating microwaves into the cooking cavity, a steaming unit including a steaming container made of a microwave penetrable material and installed to an upper portion of the cabinet such that a lower portion of the steaming container is placed in the cooking cavity, the steaming container being open at a top thereof, and a cover to selectively close the open top of the steaming container.

A container seating opening is formed at a predetermined position on the upper portion of the cabinet such that the steaming container is removably installed to the upper portion of the cabinet, and the steaming container is seated in the container seating opening such that an outer circumferential surface of the steaming container is in close contact with an edge of the container seating opening.

The microwave oven includes a closure member to close the container seating opening when the steaming container is removed from the container seating opening.

The steaming container includes a net-shaped support member provided at a position spaced apart from a bottom wall of the steaming container by a predetermined height such that food received in the steaming container is spaced apart from water contained in the lower portion of the steaming container.

The steaming container is designed to form a step such that an outer diameter of the steaming container is stepwise reduced in a direction from an upper portion of the steaming container to the lower portion thereof.

A tray to rotatably support food is interiorly installed to a bottom of the cooking cavity such that the food is cooked by a microwave heating operation.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENT

Figure 1:
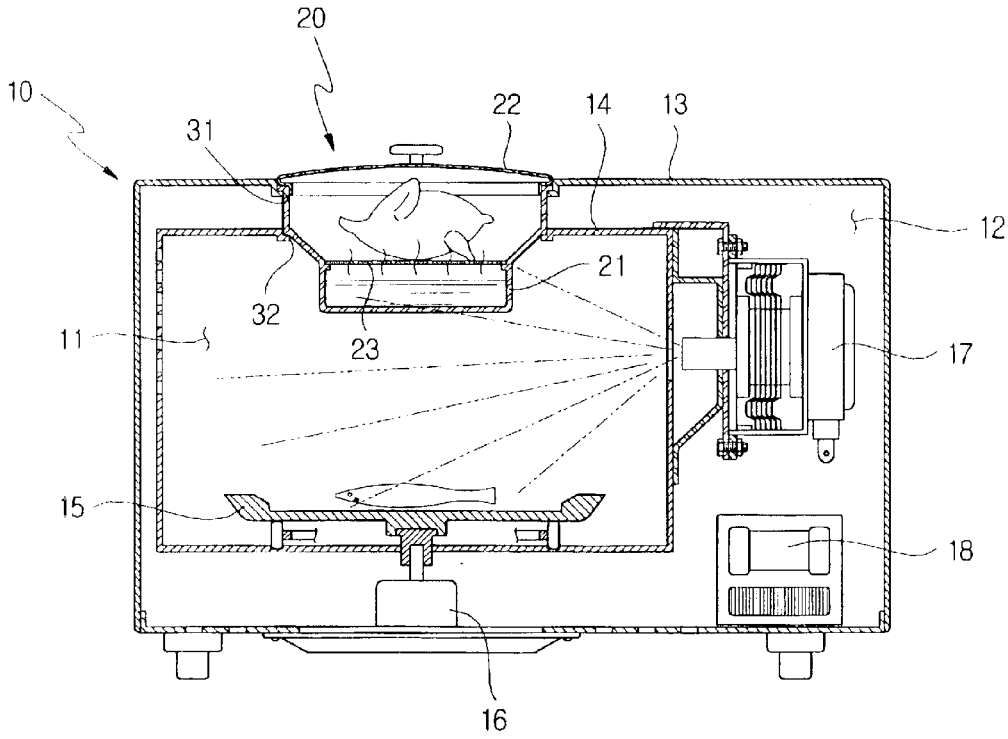
FIG. 1 is a sectional view showing a microwave oven according to an embodiment of the present invention, with a steaming unit mounted to the microwave oven.

Reference will now be made in detail to the present preferred embodiment of the present invention, examples of which are illustrated in the accompanying drawings, wherein like reference numerals refer to like elements throughout. The embodiment is described below in order to explain the present invention by referring to the figures.

As shown in FIG. 1, the microwave oven according to an embodiment of the present invention includes a cabinet 10. The cabinet 10 is partitioned into a cooking cavity 11 and a machine room 12. The cooking cavity 11 is used to cook food. The machine room 12 includes several electrical devices. The cabinet 10 also has an outer casing 13. An inner casing 14 is placed in the outer casing 13, and defines the cooking cavity 11. The inner casing 14 partitions the cabinet 10 into the cooking cavity 11 and the machine room 12.

A tray 15 is rotatably provided on a bottom of the cooking cavity 11 such that the food to be heated by microwaves is placed on the tray 15. A motor 16 is installed under the cooking cavity 11, rotating the tray 15. A magnetron 17 and a high-voltage transformer 18 are provided in the machine room 12. The magnetron 17 irradiates microwaves into the cooking cavity 11. The high-voltage transformer 18 applies high voltage to the magnetron 17. Such a construction allows the food placed on the tray 15, provided in the cooking cavity 11, to be cooked by the microwaves irradiated from the magnetron 17.

Further, the microwave oven allows the food to be cooked through a microwave heating operation and allows food to be cooked using steam generated through the microwave heating operation, simultaneously. The aspect of the present invention is achieved by providing a steaming unit 20 on an upper portion of the cooking cavity 11.

Figure 3:
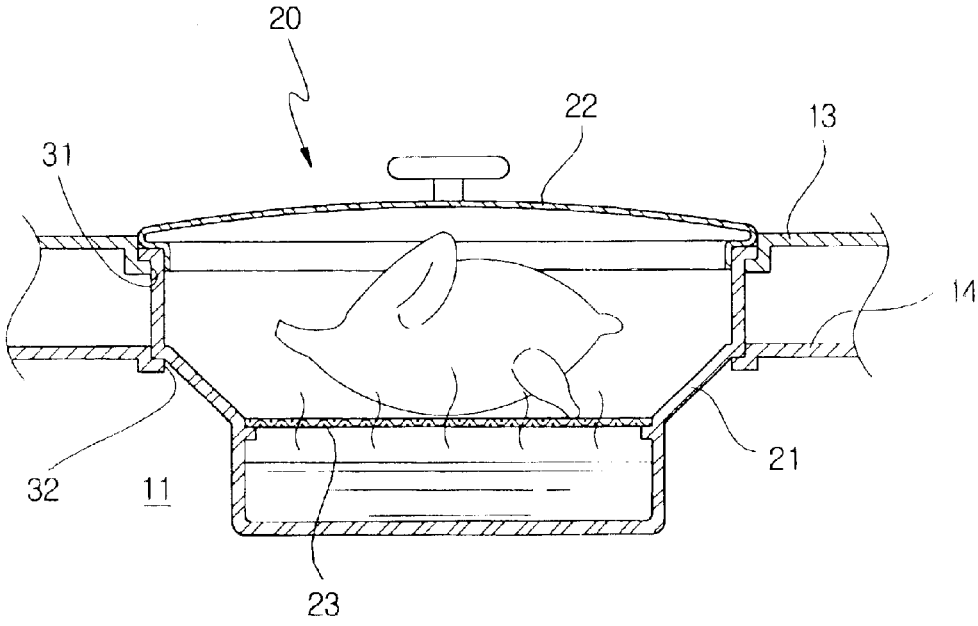
FIG. 3 is a partial sectional view of the steaming unit included in the microwave oven of FIG. 1.

As shown in FIG. 3, the steaming unit 20 includes a steaming container 21 and a cover 22. The steaming container 21 is installed to an upper portion of the cabinet 10 such that a lower portion of the steaming container 21 is placed in the cooking cavity 11. The steaming container 21 is open at a top thereof. The cover 22 selectively closes the open top of the steaming container 21. Further, upper and lower container seating openings 31 and 32 are formed at corresponding positions on upper portions of the outer and inner casings 13 and 14 of the cabinet 10 such that the steaming container 21 is removably installed to the upper portion of the cabinet 10.

The upper seating opening 31 is formed on the outer casing 13, and the lower seating opening 32 is formed on the inner casing 14 so that an interior of the cooking cavity 11 communicates with an outside of an upper end of the cabinet 10. The upper and lower container seating openings 31 and 32 allow the steaming container 21 to be removably installed to the upper portion of the cabinet 10. The upper and lower container seating openings 31 and 32 allow a lower portion of the steaming container 21 to be placed in the cooking cavity 11 when the steaming container 21 is seated in the upper and lower container seating openings 31 and 32.

The steaming container 21 is designed to form a step such that an outer diameter of the steaming container 21 is stepwise reduced in a direction from an upper portion of the steaming container 21 to the lower portion of the steaming container 21. That is, the steaming container 21 is designed such that the upper portion thereof has outer diameters corresponding to the diameters of the upper and lower container seating openings 31 and 32, so the steaming container 21 is seated in the upper and lower container seating openings 31 and 32 such that an outer circumferential surface of the upper portion of the steaming container 21 is in close contact with edges of the upper and lower container seating openings 31 and 32. Further, the steaming container 21 is designed such that the lower portion thereof has an outer diameter smaller than an outer diameter of the upper and lower container seating openings 31 and 32, so the lower portion of the steaming container 21 can be inserted into the cooking cavity 11. The steaming container 21 is made of a microwave penetrable material, such as glass or ceramics, so a predetermined quantity of water, contained in the steaming container 21, is heated by microwaves which irradiate from the cooking cavity 11 into the steaming container 21. A cover 22 may be made of a metal which shields the microwaves. Alternatively, metal may be attached to an inside surface of the cover 22 made of another material.

The steaming container 21 has a net-shaped support member 23 provided at a position spaced apart from a bottom wall of the steaming container 21 by a predetermined height such that food received in the steaming container 21 is spaced apart from the water contained in the lower portion of the steaming container 21. Steam generated from the water by the microwave heating operation passes through the net-shaped support member 23 and moves upward so as to heat the food received in the steaming container 21.

Figure 2:
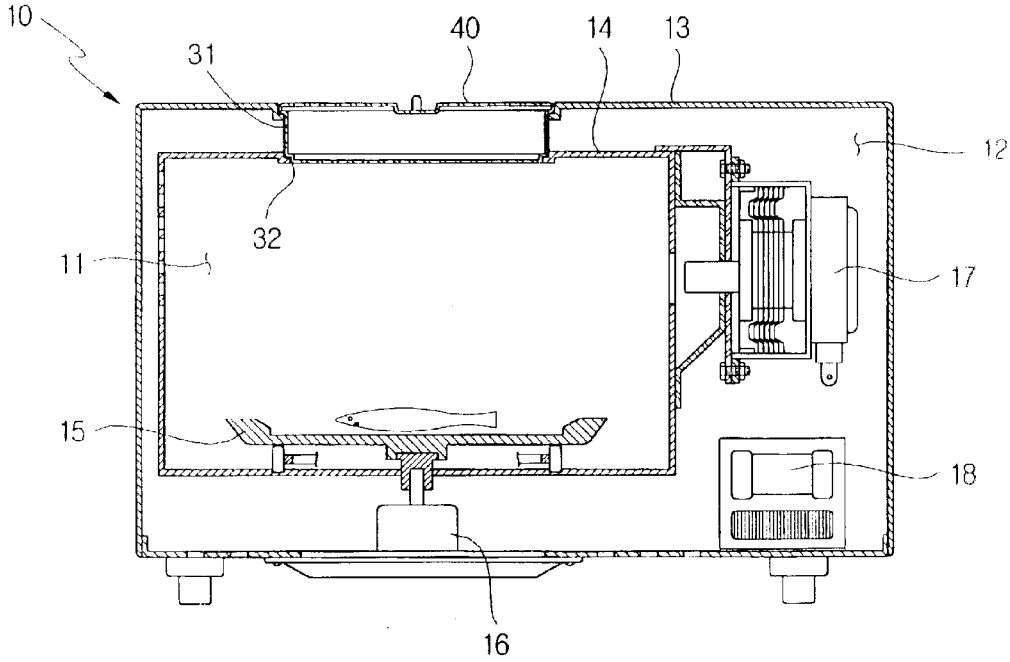
FIG. 2 is a sectional view of the microwave oven according to the embodiment of the present invention, with the steaming unit removed from the microwave oven.

As shown in FIG. 2, the microwave oven of the present invention is provided with a detachable closure member 40 to close the upper and lower container seating openings 31 and 32 when the steaming unit 20 is removed from the cabinet 10.

The operation and use of the microwave oven according to the embodiment of the present invention is as follows.

When cooking steamed food using the steaming unit 20 is desired, as shown in FIG. 1, a predetermined quantity of water is fed into the steaming container 21, and the food to be cooked is placed on the net-shaped support member 23. Next, the steaming container 21 is seated in the upper and lower container seating openings 31 and 32 of the upper portion of the cabinet 10. The open top of the steaming container 21 is closed by the cover 22.

When the microwave oven starts operating under this condition, microwaves are from the magnetron 17 irradiate the cooking cavity 11. The microwaves from the magnetron 17 irradiating the cooking cavity 11 further irradiate into the steaming container 21, thus heating the predetermined quantity of the water contained in the steaming container 21. At that time, steam is generated from the water in the steaming container 21. The food is cooked by the steam generated in the steaming container 21. Since the top of the steaming container 21 may be opened, while steaming the food a user may open the cover 22 which closes the open top of the steaming container 21 and, for example, may add a spice to the food, in the same manner as typical steaming operations. Further, when finished food is desired to be removed from the steaming container 21, the user may open the cover 22 and remove the food from the steaming container 21. When the cover 22 is opened during cooking, the magnetron 17 temporarily stops irradiating the microwaves so as to prevent a leakage of the microwaves to an outside of the microwave oven.

The microwave oven according to the embodiment of the present invention cooks one food using the steaming unit 20 and cooks another food through a microwave heating operation at a same time. That is, when the microwave oven starts operating after the one food is put into the steaming container 21 and the other food is placed on the tray 15 provided in the cooking cavity 11, the water contained in the steaming container 21 and the other food placed on the tray 15 are simultaneously heated by the microwaves, thus cooking the one steamed food and cooking the other food through the microwave heating operation at the same time.

Further, as shown in FIG. 2, when cooking through only the microwave heating operation is desired, the steaming unit 20 is removable from the cabinet 10, so an interior capacity of the cooking cavity 11 is enlargeable. In this case, the detachable closure member 40 is seated in the upper and lower container seating openings 31 and 32, formed on the upper portion of the cabinet 10, so as to close the upper and lower container seating openings 31 and 32.

As apparent from the above description, a microwave oven, which is designed to generate steam in a steaming unit provided on an upper portion of a cabinet through a microwave heating operation, is provided, thus allowing food to be steamed.

A microwave oven is provided, which is designed such that a steaming unit is mounted on an upper portion of a cabinet, and a tray is provided in a cooking cavity. The microwave oven thus cooks one food on the tray through a microwave heating operation, and cooks another food through a steam heating operation at the same time.

Furthermore, a microwave oven is provided, which is designed such that a steaming unit is removable from a cabinet as desired, thus being convenient to use.

Although a preferred embodiment of the present invention has been shown and described, it would be appreciated by those skilled in the art that changes may be made in the embodiment without departing from the principles and spirit of the invention, the scope of which is defined in the claims and their equivalents.

What is claimed is:

1. A microwave oven including a cabinet provided with a cooking cavity therein and a microwave irradiating unit irradiating microwaves into the cooking cavity, comprising:

a steaming container made of a microwave penetrable material and disposed at an upper portion of the cabinet such that a lower portion of the steaming container is placed in the cooking cavity, the steaming container being open at a top thereof; and a cover to selectively close the open top of the steaming container.

2. The microwave oven according to claim 1, further comprising:

a container seating opening formed at a predetermined position on the upper portion of the cabinet such that the steaming container is removably disposed at the upper portion of the cabinet, the steaming container seated in the container seating opening such that an outer circumferential surface of the steaming container is in contact with an edge of the container seating opening.

3. The microwave oven according to claim 2, further comprising:

a closure member to close the container seating opening when the steaming container is removed from the container seating opening.

4. The microwave oven according to claim 1, wherein the steaming container comprises:

a net-shaped support member provided at a position spaced apart from a bottom wall of the steaming container by a predetermined height such that food received in the steaming container is spaced apart from water contained in the lower portion of the steaming container.

5. The microwave oven according to claim 1, wherein the steaming container forms a step such that an outer diameter of the steaming container is stepwise reduced in a direction from an upper portion thereof to the lower portion thereof.

6. The microwave oven according to claim 1, further comprising:

a tray to rotatably support food and interiorly installed to a bottom of the cooking cavity such that the food is cooked through a microwave heating operation.

7. A microwave oven including a cooking cavity therein and a microwave irradiating unit irradiating microwaves into the cooking cavity, comprising:

a steaming unit comprising:

a steaming container removably disposed therein to steam food by water irradiated by the microwaves such that only a portion of the steaming container is disposed in the cooking cavity, and a cover to selectively dose an opening of the steaming container to access the food.

8. The microwave oven according to claim 7, further comprising:

a cabinet disposed surrounding the cooking cavity comprising:

outer and inner casings such that the steaming container is removably disposed in an upper portion of the cabinet.

9. The microwave oven according to claim 8, further comprising:

inner and outer casings having an upper seating opening and a lower seating opening, respectively, each of the upper seating opening and the lower seating opening corresponding with respective outer diameters of the steaming container at predetermined positions thereof to seal off the upper seating opening and a lower seating opening when the steaming container is seated at the upper and lower seating openings.

10. The microwave oven according to claim 7, further comprising inner and outer casings having an upper seating opening and a lower seating opening, respectively, to provide an opening to the cooking cavity at an upper end of the cabinet.

11. The microwave oven according to claim 10, wherein the upper and lower seating openings allow a lower portion of the steaming container to be placed in the cooking cavity when the steaming container is seated in the upper and lower container seating openings.

12. The microwave oven according to claim 10, wherein:

the steaming container has an outer diameter which is reduced in a direction from an upper portion of the steaming container to the lower portion of the steaming container; and the upper and lower seating openings have outer diameters corresponding to predetermined outer diameters of the steaming container such that an outer circumferential surface of the upper portion of the steaming container is in contact with edges of the upper and lower seating openings when the steaming container is seated.

13. The microwave oven according to claim 10, wherein the lower portion of the steaming container has an outer diameter smaller than an outer diameter of either of the upper and lower seating openings so that the lower portion of the steaming container is insertable into the cooking cavity.

14. The microwave oven according to claim 10, further comprising:

a closure member to close the opening to the cooking cavity at the upper end of the cabinet when the steaming container is removed from the cabinet.

15. The microwave oven according to claim 14, wherein the closure member closes the upper and lower seating openings when the steaming container is removed from the cabinet.

16. The microwave oven according to claim 14, wherein the closure member is detachable.

17. The microwave oven according to claim 7, wherein the steaming container is made of a microwave penetrable material and water contained in the steaming container is heated by the microwaves which irradiate the cooking cavity to generate steam.

18. The microwave oven according to claim 17, wherein the steaming container is made of one of glass or ceramic.

19. The microwave oven according to claim 7, wherein the cover is made of metal.

20. The microwave oven according to claim 7, wherein the cover comprises:

a metal layer disposed at a surface of the cover.

21. The microwave oven according to claim 7, wherein, when the steaming container is removed, an interior capacity of the cooking cavity is enlarged compared to the interior capacity of the cooking cavity when the steaming container is seated.

22. The microwave oven according to claim 7, wherein the steaming container comprises:

a lower portion thereof including a bottom wall; and a support member provided at a position spaced apart from the bottom wall of the steaming container to space apart the food placed in the steaming container from water stored in the lower portion of the steaming container.

23. The microwave oven according to claim 7, wherein the steaming container forms a step such that an outer diameter of the steaming container is reduced in a direction from an upper portion thereof to the lower portion thereof.

24. The microwave oven according to claim 7, further comprising:

a rotatable tray to support another food disposed at a bottom of the cooking cavity to be cooked through a microwave irradiating operation.

25. A microwave oven including a cooking cavity therein with a door to access the cooking cavity and a microwave irradiating unit irradiating microwaves into the cooking cavity, comprising:

a steaming container to steam food disposed therein by heating water irradiated by the microwaves and having only a water storing portion of the steaming container in the cooking cavity; and a cover to selectively access an opening of the steaming container without opening the door of the microwave oven.

26. A method of cooking food using a microwave oven including a cooking cavity therein, a steaming container having a net shaped support member and upper and lower container seating openings, and a microwave irradiating unit to irradiate microwaves into the cooking cavity, comprising:

storing a predetermined quantity of water in a portion of the steaming container;

placing the food on the net shaped support member;

seating the steaming container in the upper and lower container seating openings such that the portion of the steaming container, storing the water, is disposed in the cooking cavity;

closing the steaming container after the placing; and irradiating the portion of the steaming container, storing the water, with the microwaves so as to generate steam to cook the food.

27. A method of cooking using a microwave oven including a cooking cavity therein and a microwave irradiating unit to irradiate microwaves into the cooking cavity, a steaming container to steam food removably disposed at an opening of the cooking cavity such that a portion thereof is in the cooking cavity and a cover to selectively close the opening of the steaming container to access the food placed in the steaming container, comprising:

irradiating the portion of the steaming container in the cooking cavity when the cover closes the opening of the steaming container; and stopping the irradiation of the portion of the steaming container in the cooking cavity when the cover is opened during a microwave irradiating operation.

28. A method of cooking using a microwave oven including a cooking cavity therein and a microwave irradiating unit to irradiate microwaves into the cooking cavity, a steaming container to steam food removably disposed at an opening of the cooking cavity such that a portion thereof is in the cooking cavity, comprising:

cooking one food using a direct microwave irradiating operation; and cooking another food, while simultaneously cooking by the direct irradiating operation, using a steaming operation by using the microwaves to heat in the portion of the steaming container disposed in the cooking cavity.

* * * * *